US010830470B1

(12) United States Patent
Bevan et al.

(10) Patent No.: US 10,830,470 B1
(45) **Date of Patent: *Nov. 10, 2020**

(54) FLOATING THERMOSTAT PLATE

(71) Applicant: Vivint, Inc., Provo, UT (US)

(72) Inventors: Scott Bevan, Lehi, UT (US); James Beagley, Taylorsville, UT (US); Jason C. Flint, Provo, UT (US)

(73) Assignee: Vivint, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/297,307

(22) Filed: Mar. 8, 2019

Related U.S. Application Data

(63) Continuation of application No. 14/586,430, filed on Dec. 30, 2014, now Pat. No. 10,228,151.

(51) Int. Cl.

| | |
|---|---|
| ***F24F 11/30*** | (2018.01) |
| ***F24F 11/52*** | (2018.01) |
| ***F24F 11/56*** | (2018.01) |
| ***F24F 110/10*** | (2018.01) |
| ***F24F 110/00*** | (2018.01) |

(52) U.S. Cl.
CPC ..... *F24F 11/30* (2018.01); *F24F 11/52* (2018.01); *F24F 11/56* (2018.01); *F24F 2110/00* (2018.01); *F24F 2110/10* (2018.01)

(58) Field of Classification Search
CPC .. F24F 11/30; F24F 11/52; F24F 11/56; F24F 2110/00; F24F 2110/10
See application file for complete search history.

(56) References Cited

U.S. PATENT DOCUMENTS

| | | | | |
|---|---|---|---|---|
| 4,295,180 | A * | 10/1981 | Herron | H05K 5/0017 236/94 |
| 5,107,918 | A | 4/1992 | McFarlane et al. | |
| 5,202,559 | A | 4/1993 | Durst | |
| 5,979,764 | A | 11/1999 | Swyst et al. | |
| 6,850,252 | B1 | 2/2005 | Hoffberg | |
| 7,310,084 | B2 | 12/2007 | Shitanaka et al. | |
| 7,436,398 | B2 | 10/2008 | Yuasa et al. | |
| 8,576,199 | B1 | 11/2013 | Pryor | |
| 2003/0150925 | A1 | 8/2003 | Archacki et al. | |
| 2006/0063522 | A1 | 3/2006 | McFarland | |
| 2006/0186214 | A1 | 8/2006 | Simon et al. | |
| 2009/0167704 | A1 | 7/2009 | Terlizzi et al. | |
| 2011/0110023 | A1 | 5/2011 | Rylski et al. | |
| 2011/0112701 | A1 | 5/2011 | Johnson et al. | |
| 2011/0113360 | A1 | 5/2011 | Johnson et al. | |
| 2011/0240448 | A1 | 10/2011 | Springer et al. | |

(Continued)

FOREIGN PATENT DOCUMENTS

| | | | |
|---|---|---|---|
| GB | 2484789 | A | 4/2012 |

*Primary Examiner* — Henry T Crenshaw
(74) *Attorney, Agent, or Firm* — Holland & Hart, LLP

(57) ABSTRACT

Methods and systems are described for operating a wall mounted thermostat. An example computer-implemented method includes receiving an indication of a physical touch to an exposed portion of a housing of the thermostat, wherein the housing is movable when touched. The method also includes determining a thermostat command associated with where the housing is touched and movement of the housing in response to the touch, and operating the thermostat according to the determined thermostat command.

15 Claims, 11 Drawing Sheets

(56) References Cited

U.S. PATENT DOCUMENTS

| | | | | |
|---|---|---|---|---|
| 2012/0032907 | A1* | 2/2012 | Koizumi | G06F 3/0414 345/173 |
| 2012/0061480 | A1* | 3/2012 | Deligiannis | G05B 15/02 236/51 |
| 2013/0263034 | A1* | 10/2013 | Bruck | G05D 23/1904 715/771 |
| 2013/0292481 | A1 | 11/2013 | Filson et al. | |
| 2013/0345882 | A1* | 12/2013 | Dushane | G05B 15/02 700/276 |
| 2014/0084072 | A1* | 3/2014 | Conner | G05D 23/1919 236/1 C |
| 2014/0358293 | A1 | 12/2014 | Fadell et al. | |
| 2015/0159904 | A1 | 6/2015 | Barton | |
| 2015/0316285 | A1* | 11/2015 | Clifton | F24D 19/10 236/1 C |
| 2017/0212485 | A1* | 7/2017 | Lee | G05B 15/02 |
| 2018/0119978 | A1* | 5/2018 | Becker | F24D 19/10 |

* cited by examiner

FLOATING THERMOSTAT PLATE

CROSS REFERENCE

The present application is a continuation of U.S. patent application Ser. No. 14/586,430, titled: "FLOATING THERMOSTAT PLATE," filed on Dec. 30, 2014, and assigned to the assignee hereof, the disclosure of which is incorporated by reference herein in its entirety.

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of home automation and security products. Advancements in mobile devices allow users to monitor and/or control an aspect of a home or business. As home automation and security products expand to encompass other systems and functionality in the home, opportunities exist for improved thermostat control, including thermostat functionality, aesthetics, and interfaces with users.

SUMMARY

Methods and systems are described for operating a wall mounted thermostat. An example computer-implemented method includes receiving an indication of a physical touch to an exposed portion of a housing of the thermostat, wherein the housing is movable when touched. The method also includes determining a thermostat command associated with where the housing is touched and movement of the housing in response to the touch, and operating the thermostat according to the determined thermostat command.

In one example, the entire housing is movable. The thermostat command may include at least one of a temperature adjustment, a heat on/off actuation, a cool on/off actuation, a fan adjustment, a setup mode operation, a query of a state or status of one or more system functions, an acknowledgement or clearing of a status indicator, or an input or feedback related to at least one of an HVAC zone selection, a damper control, an air exchanger control, a humidifier control, a dehumidifier control, and an air leaning system control. Operating the thermostat may include transmitting instructions to an HVAC device and/or receiving information from the HVAC device. The method may include displaying information on a display screen mounted to or visible through the housing. The method may include detecting presence of a user in proximity to the thermostat, and executing a programmed response to the detected presence, such as operating a light of the thermostat.

Another embodiment is directed to a wall mounted thermostat that includes a housing and at least one sensor operable to determine movement of the housing and to determine a location where the housing is touched to generate the movement. Movement of the housing in any of a plurality of directions relative to a wall to which the thermostat is mounted and where the housing is touched as detected by the at least one sensor initiates a thermostat adjustment.

In one example, the housing may be movable toward or away from a support surface to which the thermostat is mounted. The housing may be movable laterally relative to a support surface to which the thermostat is mounted. The housing may be movable vertically relative a support surface to which the thermostat is mounted. The housing may include a display screen. The housing may have at least one of a rectangular, circular, triangular, and hemispherical shape. The housing may pivot about a ball and socket joint relative to a support surface to which the thermostat is mounted. The at least one sensor may detect movement of the housing in at least four different directions of movement. The thermostat may include a base member mounted to the wall, and the housing may be supported by and movable relative to the base member. The at least one sensor may be positioned in the base member. The housing may be supported by the base at one or more locations. The thermostat may include a transceiver operable to communicate with at least one of an HVAC device, a control panel, a remote computing device, and a central station. The thermostat may include a processor, memory, and a power supply, wherein the processor may be operable to determine using input from the at least one sensor what thermostat adjustment corresponds to the housing movement and the location where the housing is touched.

A further embodiment is directed to a computing device configured for controlling a thermostat. The computing device includes a processor, and memory in electronic communication with the processor. The memory stores computer executable instructions that when executed by the processor cause the processor to perform the steps of receiving an indication of a physical touch to an exposed portion of a housing of the thermostat, determining a thermostat operation associated with where the housing is touched, and controlling the thermostat according to the determined thermostat operation.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
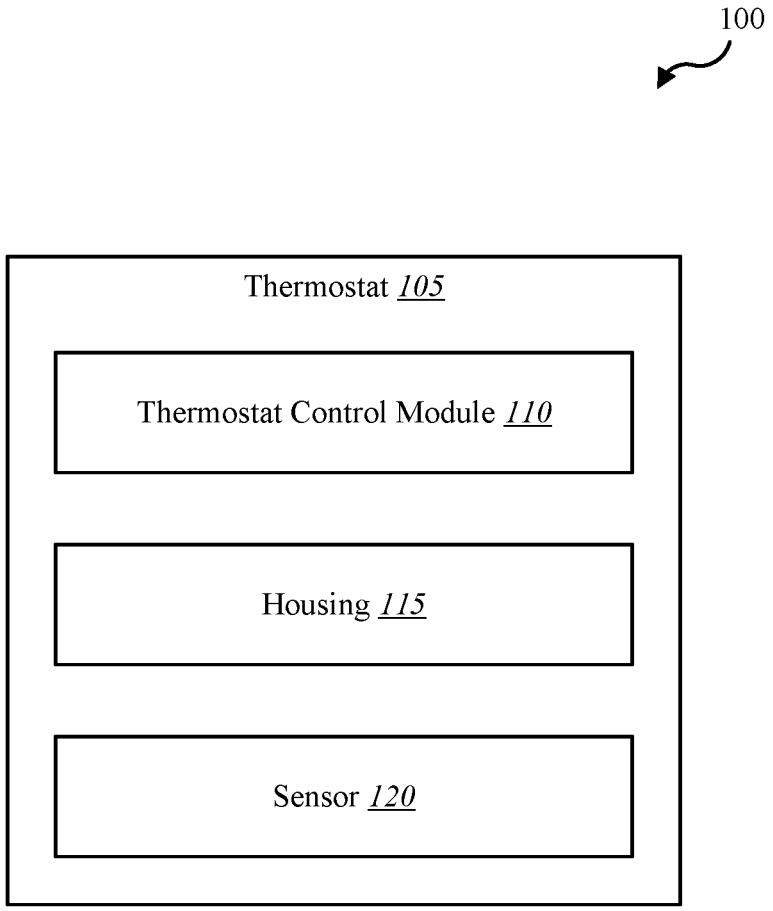
FIG. 1 is a block diagram of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein may, at least in part, relate to home automation and home security, and related security systems and automation for use in commercial and business settings. As used herein, the phrase "home automation system" may refer to a system that includes automation features alone, security features alone, a combination of automation and security features, or a combination of automation, security and other features. While the phrase "home automation system" is used throughout to describe a system or components of a system or environment in which aspects of the present disclosure are described, such an automation system and its related features (whether automation and/or security features) may be generally applicable to other properties such as businesses and commercial properties as well as systems that are used in indoor and outdoor settings.

Wall mounted thermostats typically include a housing and one or more actuators mounted to the housing and exposed for operation by a user. The actuators may include buttons, switches, or the like. In some examples, the actuator is defined as an active area on a touch screen or other displayed feature on the housing. The combination of a housing and one or more actuators may be aesthetically unattractive, particularly when the thermostat is located in a prominent place in a user's living space.

One aspect of the present disclosure relates to a thermostat, such as a wall mounted thermostat for use in a home or commercial property, that is operable at least in part by moving at least a portion of the thermostat housing. In one example, the entire portion of the housing that is exposed for viewing by a user is movable to make functional thermostat adjustments. Because the entire housing functions as the "actuator" for the thermostat, the housing may be given a more aesthetically pleasing design.

In one example, the housing has a plate shape (e.g., a significantly greater length and/or width as compared to thickness). Touching the housing at various locations may result in different thermostat adjustments. For example, a front facing primary surface of the plate shaped housing may be pressed or pushed along a top, center portion and/or edge to provide an adjustment in temperature, and may be pressed/pushed along a bottom, center portion and/or edge to provide a decrease in temperature adjustment. Pressing/pushing the plate-shaped housing in other areas on the housing (e.g., at different areas of the front facing primary surface or along side edges) may actuate other functions such as turning on/off heating, turning on/off cooling, turning on/off fan, adjusting time of day setting, initiating setup, or the like.

In one embodiment, a rectangular-shaped housing may have nine or more active areas positioned on a front facing primary surface of the housing: each of four corners, four locations between the corners along edges of the housing, and the center of the housing. The housing may have indicators positioned on the front facing primary surface at each of the active areas to direct the user to locations for actuating the housing. The movable housing may provide most, if not all of the thermostat controls available on a typical wall mounted thermostat. Pressing/pushing on the active areas and/or indicators of the housing may physically move that portion of the housing to create a desired thermostat command or adjustment. The thermostat may include one or a plurality of sensors that detect movement of the housing as part of determining what thermostat adjustment the user intends to make. The sensors may be mounted directly to the housing or mounted to the wall. The housing may have other shapes such as a round, triangular, hexagonal, cylindrical, or hemispherical shape. The housing may be sized, for example, to be grasped by a single hand of a user to facilitate moving the housing.

The thermostat may include a base portion that is mounted to the wall, and the housing (e.g., structure that includes an exposed front facing primary surface of the plate) is mounted to the base. The housing may move relative to the base. The housing may move in various directions relative to the base to provide the thermostat adjustments. For example, the housing may move toward and/or away from the wall in a Y-axis direction (e.g., in a direction normal to and/or perpendicular to the wall surface and/or front surface of the base portion). The housing may move laterally in parallel with the plane of the wall in the X-axis direction. The housing may move vertically in parallel with the plane of the wall in the Z-axis direction. Alternatively, the housing may rotate relative to the base/wall. The housing may pivot about a ball joint, slide along a track, and/or may ratchet or "click" into different actuated positions relative to the base/wall.

The thermostat may include, in addition to a plurality of sensors that detect movement of the housing, a processor, memory, a transceiver, a user interface, a proximity sensor, and a power supply. The thermostat may include other types of sensors such as temperature and humidity sensors. The thermostat may have lighting, a display, or other functionality that is maintained in a sleep mode until a user's presence is detected in close proximity of the thermostat.

FIG. 1 is a block diagram illustrating one embodiment of an environment 100 in which the present systems and methods may be implemented. In some embodiments, the systems and methods described herein may be performed at least in part on or using a thermostat 105. Thermostat 105 may include a thermostat control module 110, a housing 115, and at least one sensor 120. While thermostat control module 110 is shown as a component of thermostat 105 that is integral with or combined with housing 115 and sensor 120, other embodiments may include thermostat control module 110 positioned separate from housing 115 and sensor 120 (e.g., at a control panel of a home automation system with which thermostat 105 is associated).

Thermostat control module 110 may set or adjust one or more settings or functions of thermostat 105 based at least in part on movement of all or portions of housing 115. The movement of housing 115 may be determined using sensor 120. Thermostat control module 110 may, in addition to receiving input about movement of housing 115, receive inputs about where the housing 115 is touched (e.g., based on feedback from sensor 120). One or both of touch location and movement of housing 115 may be used as inputs for determining what settings or functions of thermostat 105 may be set or adjusted by thermostat control module 110.

Thermostat control module 110 may generate control signals that are used to adjust settings of a heating, ventilation, and air conditioning (HVAC) system. Thermostat control module 110 may also operate to adjust a humidity device to control a humidity level, adjust a fan speed or turn on/off a fan, or operate a setup mode for thermostat 105. Additional functions related to thermostat control module 110 are described in further detail below with reference to FIG. 5.

Housing 115 includes one or more surfaces that are exposed for contact by a user. In one embodiment, housing 115 includes one exposed surface that is dedicated for receiving touch inputs from a user. The touch inputs may result in portions of the housing moving (e.g., relative to a fixed base of the thermostat or a support surface such as a vertically oriented wall to which the thermostat 105 is mounted). In other embodiments, multiple surfaces of housing 115 may be dedicated to receive touch inputs or application of force by a user, for example, to move portions of housing 115 and/or activate various functions or settings of thermostat 105. In an application in which thermostat 105 is mounted to a vertically oriented wall of a building, at least portions of housing 115 may be movable relative to the wall. The housing, or portions thereof, may be movable in an X-axis direction (horizontally in a plane parallel to the wall surface), a Y-axis direction (horizontally in a plane perpendicular to the wall surface), or a Z-axis direction (vertically in a plane parallel with the wall surface), or any combination thereof. The housing 115 may be configured to move in only certain directions of motion. In one example, housing 115 is free-floating or movable in the Y-axis direction, but fixed in the X-axis and Z-axis directions. In another example, housing 115 is free-floating or movable in the X-axis direction, but fixed in the Y-axis and Z-axis directions. In still further examples, housing 115 is free-floating or movable in two or more of the X, Y and Z-axis directions, and/or may be rotatable or pivotable about any one of the X, Y, or Z-axes. In some configurations, housing 115 is pivotable about a pivot point, such as a ball and socket joint. In other examples, housing 115 pivots about two pivot points and/or a hinge structure. Housing 115 may include multiple segments or portions that are movable relative to each other.

Typically, housing 115 provides a primary visible structure and/or surface for thermostat 105. For example, housing 115 may have a plate shaped construction that encloses or otherwise covers most if not all other components of thermostat 105, which are typically positioned behind (i.e., in a Y-axis direction) the plate shaped housing 115. Housing 115 may be designed with an aesthetically pleasing appearance having any of a variety of different shapes, sizes, colors, and the like, while still providing functionality for operating thermostat 105. Housing 115 may be interchangeable with housings of different designs (e.g., shapes, sizes, colors, etc.) to provide different appearances. Housing 115 may provide most if not all of the user interface capability for thermostat 105 to perform basic functions such as, for example, adjusting and/or setting a temperature, a humidity, a fan speed, a time of day, or other setup features.

Sensor 120 may represent any one of a plurality of different types of sensors and/or numbers of sensors. Sensor 120 may, in one example, be configured to determine movement of one or more portions of housing 115. Additionally, or alternatively, sensor 120 may determine a location of touch on the housing 115. Sensor 120 may be a touch sensor, or may be able to determine the location of the touch based on movement of housing 115 and/or movement of objects touching housing 115. Sensor 120 may be capable of determining different types of movement of housing 115 such as, for example, movement in any one of the X, Y, Z-axis directions, a rotation direction, a pivot motion, or the like. Sensor 120 may be exposed for contact on the surface of housing 115. Sensor 120 may be enclosed within or behind housing 115, such as within a base portion to which housing 115 is mounted. One or more of sensors 120 may include capabilities to measure temperature, humidity, barometric pressure, or proximity of objects to thermostat 105.

Figure 2:
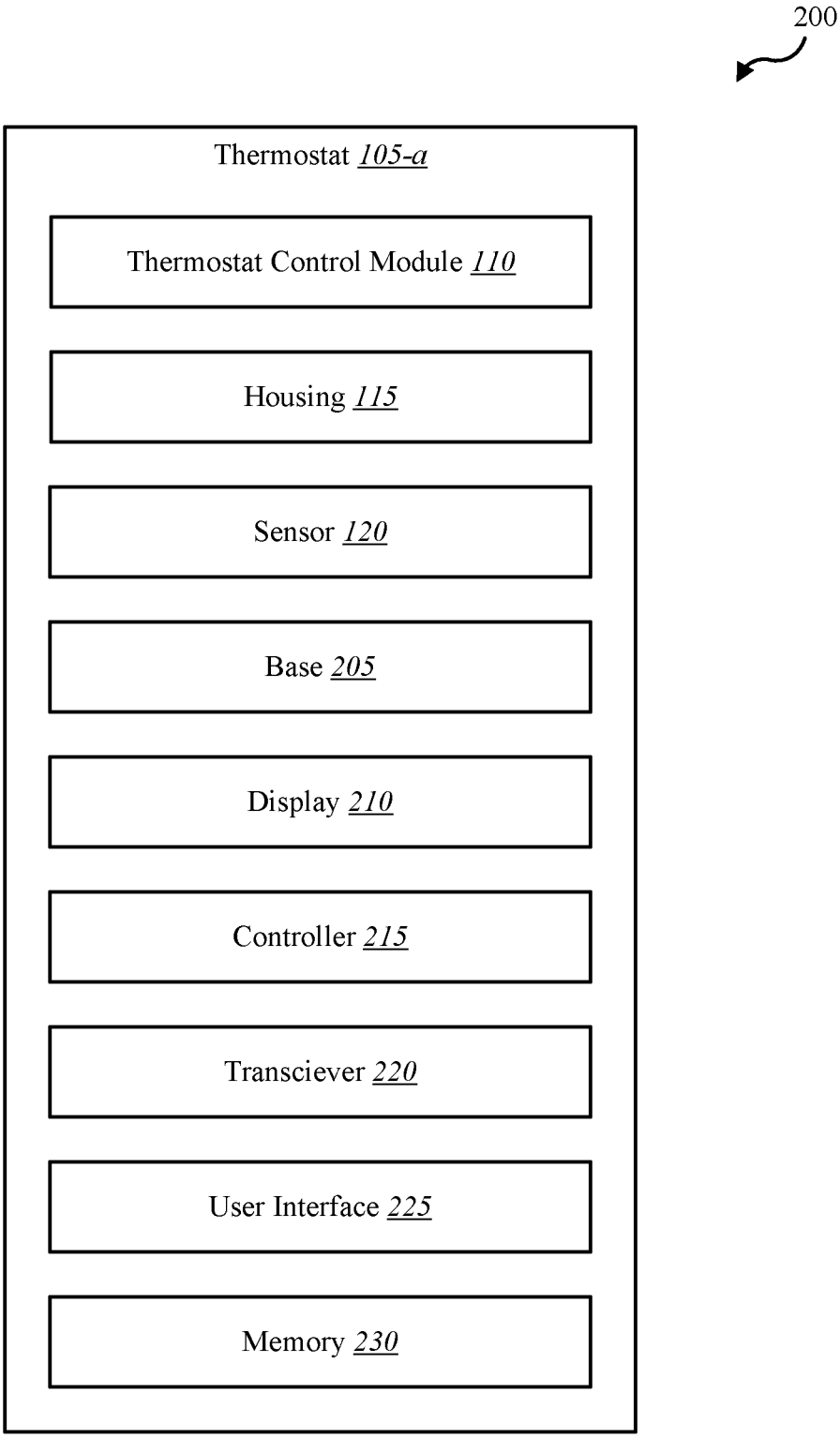
FIG. 2 is a block diagram of another environment in which the present systems and methods may be implemented.

FIG. 2 is a block diagram illustrating one embodiment of an environment 200 in which the present systems and methods may be implemented. Environment 200 may include the same or similar components as discussed above related to environment 100. In some environments, the systems and methods described herein may be formed at least in part on or using thermostat 105-*a*. Thermostat 105-*a* may include, in addition to the thermostat control module 110, housing 115, and sensor 120, a base 205, a display 210, a controller 215, a transceiver 220, a user interface 225, and memory 230.

Base 205 may be mounted to a wall surface, such as a vertically oriented surface of a wall structure in a home. Base 205 may provide support and/or stability for housing 115. Base 205 may be fixed relative to the wall surface. Housing 115 may move relative to base 205 and be supported by base 205 while moving relative to base 205 and the wall surface. Base 205 may include a cavity within which one or more components of thermostat 105-*a* may be housed. Other components of thermostat 105-*a* may be mounted to base 205, such as along and exterior surface of base 205. In at least some examples, housing 115 completely covers or encloses base 205 such that no portion of base 205 is visible when thermostat 105-*a* is mounted to the wall surface.

Base 205 may include various types of support structures for supporting housing 115 while permitting housing 115 to move in at least one direction of motion. For example, base 205 may include a track, bore, ball and/or socket feature, hinge, ratchet feature, or the like that provides an interface with one or more mating features of housing 115 to provide the desired support and/or relative movement therebetween.

Display 210 may be exposed along or visible through some portion of housing 115 and/or base 205. Display 210 may visually show one or more settings for thermostat 105-*a*, and/or convey other information such as instructions or messages for the user, temperature or humidity levels, time of day, etc. Display 210 may be carried by and movable with housing 115. In other examples, display 210 is positioned within base 205 and visible through a portion of base 205 and/or through a portion of housing 115. In one example, housing 115 includes a transparent or translucent portion through which display 210 is visible. Display 210 may display information in response to movements of housing 115, such as information confirming the setting or adjustment carried out in a response to touching and/or moving at least a portion of housing 115.

Display 210 may be capable of projecting an image onto a portion of housing 115, other component of thermostat 105-*a*, or a surface or device positioned adjacent or in close proximity to thermostat 105-*a*. Display 210 may include projection features such as light projection and/or laser control functionality. Display 210 may be mounted to or positioned at any desired position relative to housing 115 to provide the projected image and/or information on a target surface.

Controller 215 may provide at least some of the processing related to operation of thermostat control module 110. Controller 215 may provide instructions or otherwise control other components of thermostat 105-*a* (e.g., in response to instructions from thermostat control module 110), such as sensor 120, display 210, transceiver 220, user interface 225, and memory 230.

Transceiver 220 may operate to send and/or receive data from thermostat 105-*a* and a remote device. For example, transceiver 220 may send instructions to an HVAC system to, for example, increase or decrease a temperature, humidity level, or fan speed. Transceiver 220 may receive communications (e.g., instructions) from other sources such as, for example, a control panel of a home automation system for the property where thermostat 105-*a* resides. In another example, transceiver 220 receives instructions from a remote computing device such as, for example, a smartphone, a tablet computer, a laptop computer, or the like operated by a user (e.g., homeowner) for operation of thermostat 105-*a*, or even a central station for the home automation system.

User interface 225 may be provided on or in housing 115 and/or base 205. User interface 225 may provide a back-up control system in the event that the movements of and/or touching of housing 115 does not operate to control thermostat 105-*a*. For example, user interface 225 may include an on/off switch, reboot button, temperature hold, or other feature related to operation of thermostat 105-*a*.

Memory 230 may store information related to operation of thermostat 105-*a*. In one example, memory 230 stores historical information related to the temperature settings and/or adjustments of other features related to thermostat 105-*a*. Thermostat control module 110 may operate to provide suggestions to the user based on the historical data stored in memory 230. In other examples, thermostat control module 110 may automatically adjust thermostat 105-*a* based on historical data that is "learned" from the thermostat settings over time (e.g., adjustments made according to certain times of day, days of week, or months of the year).

Figure 3:
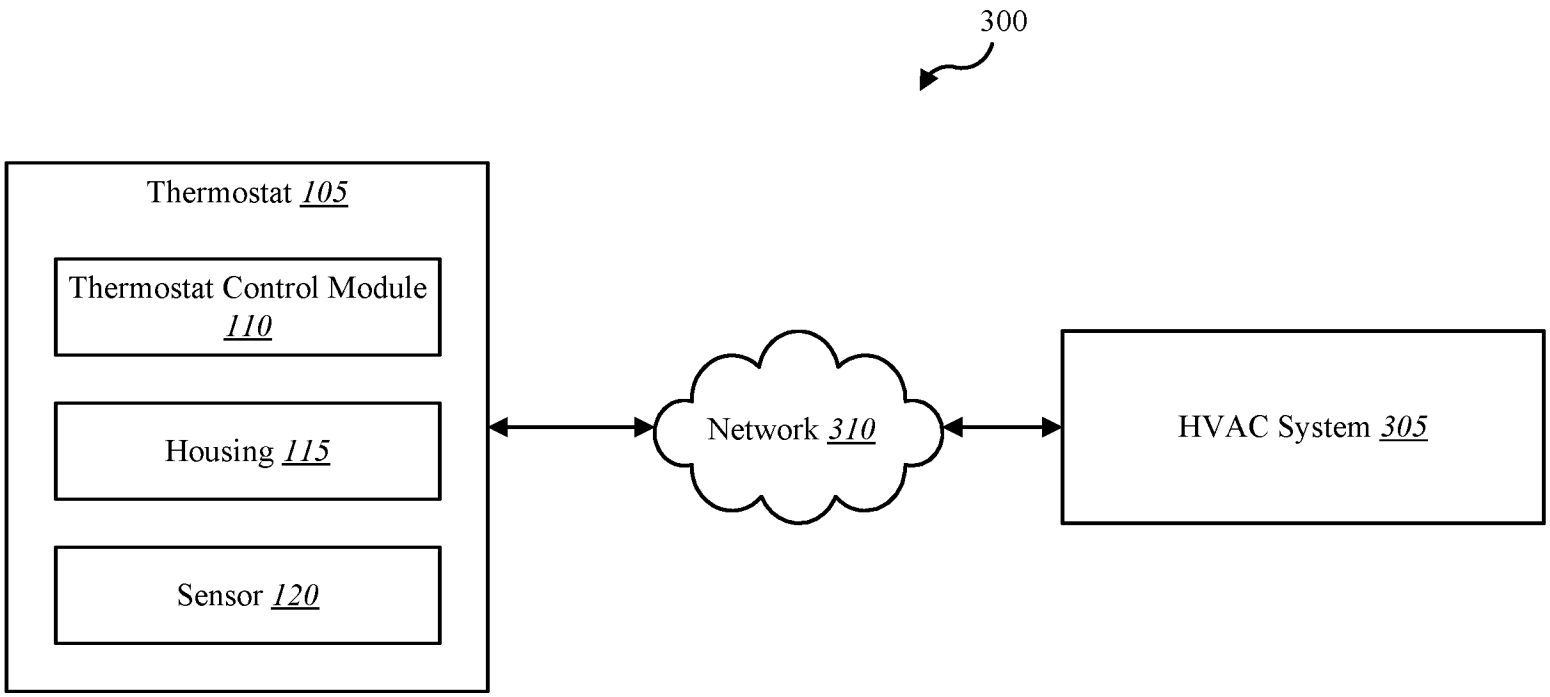
FIG. 3 is a block diagram of another environment in which the present systems and methods may be implemented.

FIG. 3 is a block diagram illustrating one embodiment of an environment 300 in which the present systems and methods may be implemented. Environment 300 may include at least some of the components of environments 100, 200, described above. Environment 300 may include the thermostat 105 shown in FIG. 1 and may additionally include an HVAC system 305 that communicates with thermostat 105 via a network 310.

HVAC system 305 may operate to provide heating, cooling, humidity control, airflow, and the like for a property. Thermostat 105 may communicate with HVAC system 305 wirelessly (e.g., via network 310) or through a wired connection. HVAC system 305 may include a plurality of different components and/or devices positioned at various locations on a property.

Network 310 may utilize any available communication technology such as, for example, Bluetooth, Zigby, Z-wave, infrared (IR), radio frequency (RF), near field communication (NFC), or other short distance communication technologies. In other examples, network 310 may include cloud networks, local area networks (LAN), wide area networks (WAN), virtual private networks (VPN), wireless networks (using 802.11 for example), and/or cellular networks (e.g., using 3G and/or LTE), etc. In some embodiments, network 310 may include the internet.

Figure 4:
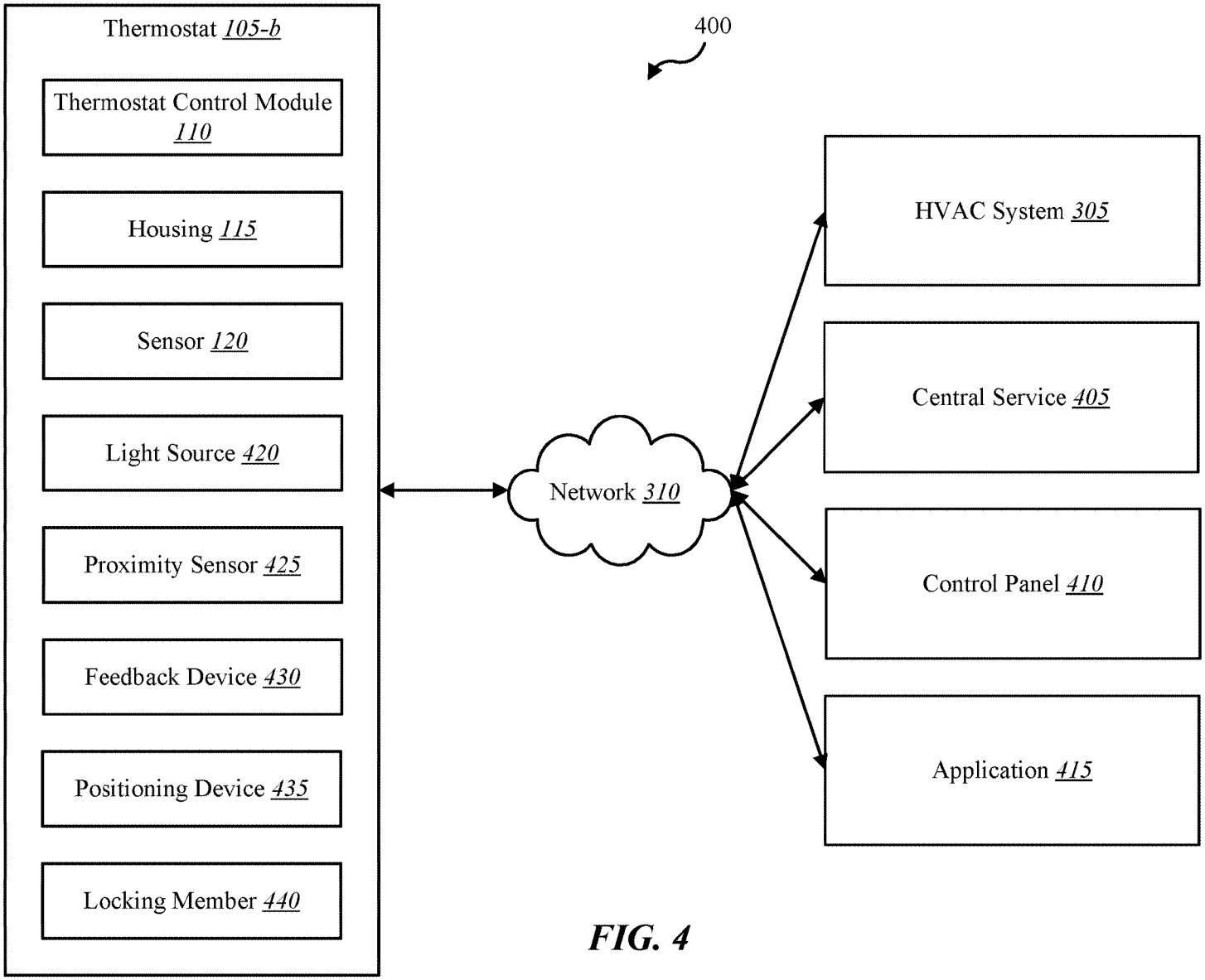
FIG. 4 is a block diagram of another environment in which the present systems and methods may be implemented.

FIG. 4 is a block diagram illustrating one embodiment of an environment 400 in which the present systems and methods may be implemented. Environment 400 may include at least some of the same components of the environment's 100, 200, 300 described above.

Environment 400 may include thermostat 105-*b* that communicates via network 310 with HVAC system 305, a central service 405, a control panel 410, and an application 415. Thermostat 105-*b* may include, in addition to thermostat control module 110, housing 115, and sensor 120, a light source 420, a proximity sensor 425, a feedback device, 430, a positioning device 435, and a locking member 440.

Central service 405 may be part of a home automation system. Central service 405 may be positioned remote from the property where thermostat 105-*b* resides. Central service 405 may provide a number of services and/or functions for the home automation system. For example, central service 405 may provide data storage, customer service, and back-end support for the home automation system and/or components associated with the home automation system (e.g., thermostat 105-*b*).

Control panel 410 may also be part of a home automation system. Control panel 410 may be located at the same property where thermostat 105-*a* resides. Control panel 410 may control components of a home automation system including, for example, sensors, cameras, speakers, locks, barriers, and the like. Control panel 410 may provide at least some control of thermostat 105-*b* or respond to data or instructions received from thermostat 105-*b*. In some examples, control panel 410 may override instructions or other input provided by a user directly to thermostat 105-*b*.

Application 415 may allow a user (e.g., a user interfacing directly with control panel 410 located at a property being monitored by the home automation system) to control, either directly or via control panel 410 and/or a separate computing device, an aspect of the monitored property including, for example, security, energy management, locking and unlocking doors, checking the status of the doors, locating a user or item, controlling lighting, thermostat, or cameras and receiving notifications regarding a current status or anomaly associated with a home, office, place of business, or the like (e.g., a property). In some configurations, application 415 may enable control panel 410 to communicate with, for example, a mobile computing device, a lock, an appliance, light source 420, a camera, a display, sensor 120, a user interface, or a handheld device, as well as other devices or systems. In one example, application 415 may provide a user interface to display automation, security, and/or energy management content on control panel 410. Thus, application 415, via, for example, a user interface and/or thermostat 105-*b*, may allow users to control aspects of their home, office, and/or other type of property, as well as control generation, delivery, and responses to messages. Further, application 415 may be installed on control panel 410 or other components and/or features of the home automation system. Control panel 410 may carry out at least some functionality of thermostat control module 110 and/or thermostat 105. For example, application 415 may provide two-way communication between thermostat control module 110 and/or thermostat 105, or delivery of a message from thermostat control module 110 to another location (e.g., central service 405 and/or control panel 410), and the like.

Sensor 120, while described above as being configured particularly for detecting motion and/or touch related to housing 115, may provide other functionality and may include a plurality of sensors. For example sensor 120 may include a camera sensor, an audio sensor, a forced entry sensor, a shock sensor, a proximity sensor, a boundary sensor, an appliance sensor, a light fixture sensor, a temperature sensor, a light beam sensor, a three-dimensional (3-D) sensor, a motion sensor, a smoke sensor, a glass break sensor, a door sensor, a video sensor, a carbon monoxide sensor, an accelerometer, a global positioning system (GPS) sensor, a Wi-Fi positioning sensor, a capacitance sensor, a radio frequency sensor, a near-field sensor, a heartbeat sensor, a breathing sensor, an oxygen sensor, a carbon dioxide sensor, a brainwave sensor, a voice sensor, a touch sensor, and the like. Thermostat 105-*b* may include one or more of sensors 120. Sensor 120 may be connected directly to any one of the components of environment 400 rather than being a part of thermostat 105-*b*.

Sensor 120 may be configured or operable to provide options for selective sensor engagement. In one example, sensor 120 (or a plurality of sensors 120) may be dynamically configured and/or operable to interpret sensor inputs based on intent of a context-aware user interface. In another example, a thermostat 105, or a component thereof such as housing 115, having a low sensor count (e.g., a sensor 120 or a relatively small number of sensors 120) may be dynamically reconfigured to perform more than one function.

Thermostat 105-*b* may include light source 420 to illuminate portions of thermostat 105-*b*. Light source 420 may operate to illuminate portions of housing 115 or an area surrounding housing 115. In some examples, housing 115 is transparent or translucent, or includes a portion thereof that is transparent or translucent for purposes of illuminating at least the input areas of housing 115 for improved user interacting in otherwise low light conditions. Light source 420 may generate light that illuminates and/or passes through the transparent or translucent portion of housing 115.

Proximity sensor 425 may detect the presence of a user in proximity to thermostat 105-*b*. Proximity sensor 425 may include, for example, a motion sensor, an optical sensor, or the like. Signals from proximity sensors 425 may be used by thermostat control module 110 to automatically operate various features of thermostat 105-*b*. For example, detection of a user in close proximity to thermostat 105-*b* via proximity sensor 425 may be used to operate light source 420 to illuminate portions of thermostat 105-*b*. Thermostat control module 110 may determine whether to operate light source 420 depending on, for example, a time of day, an ambient light condition in the area of thermostat 105-*b*, or other considerations. Detecting a user may be used to change the thermostat from a sleep state to an active state. Detecting that the user has stopped interfacing with thermostat 105-*b* for a predetermined time period may prompt actuation of a sleep mode for thermostat 105-*b*. In other embodiments, a physical touch applied by the user to a component of thermostat 105-*b* (e.g., housing 115) may initiate a processor action such as "waking up" the thermostat.

Feedback device 430 may provide feedback to the user as part of interacting with thermostat 105-*b*. For example, feedback device 430 may provide a response to the user via the user interface 225 shown in FIG. 2. The user interface 225 may include a key pad, touch screen, or the like, and feedback device 430 may generate a response to the user via the user interface 225 such as, for example, an audible or tactile vibration, an audible or tactile click, an audible or tactile pulse, a tactile friction or resistance to movement, or the like.

Feedback device 430 may operate through other portion of thermostat 105-*b* such as directly via the housing 115 or base member (described below) of thermostat 105-*b*. In one example, feedback device 430 provides a resistive force to housing 115 in response to a user's attempts to move housing 115. The force may be varied depending on certain criteria such as, for example, the type of force input applied by the user (e.g., translational or rotational force), the type of thermostat and/or other adjustment intended by the user's input, a detected user (e.g., an adult verses a child or elderly person), or the like. In other examples, feedback device 430 may move a portion of thermostat 105-*b*, such as housing 115, as part of providing feedback to the user. In other example, feedback device 430 may implement other types of feedback such as lighting, audible messages, displayed messages, or messages delivered to a portable and/or remote computing device (e.g., a smart phone carried by the user) in response to the user's input or detected presence of the user.

Feedback device 430 may be operated and/or controlled from a remote location. Feedback device 430 may be connected to a remote computing device via, for example, network 310 (see FIG. 4). The remote computing device may include, for example, a controller of HVAC system 305, computing equipment at central service 405, control panel 410, or a mobile handheld computing device such as a smart phone, tablet computer, or the like.

Positioning device 435 may operate to adjust a position of one or more features or components of thermostat 105-*b*. In one example, positioning device 435 may facilitate automated motion of a portion of thermostat 105-*b* such as housing 115 to enable the user to manipulate a portion of housing 115 as a sensor input. In another example, positioning device 435 moves an actuation member relative to housing 115, a base member that supports housing 115, or other feature of thermostat 105-*b*. The movement of the actuation member may be between operational (exposed) and non-operational (unexposed) positions. In one example, a flat-front shaped housing 115 may conceal at least one button that can be recessed or raised up relative to a front surface of housing 115 by operation of positioning device 435. The button may have a distinct geometry, or a convex or concave feature in a conformal surface thereof.

Locking member 440 may operate to provide physical locking of components or functionality of thermostat 105-*b*. Locking member 440 may lock or unlock certain types of possible motions of housing 115. In one example, locking member 440 locks out some motional degrees of freedom for housing 115 to limit specific positional translations, which may be combined with operation of the user interface for context-aware input options. In another example, if the display 210 (see FIG. 2) of thermostat 105 asks for an up/down input to housing 115 (or some other specific motional input), locking member 440 may lock out the ability to move housing 115 in other directions such as a lateral left/right direction, a rotational direction, or an in/out direction.

Figure 5:
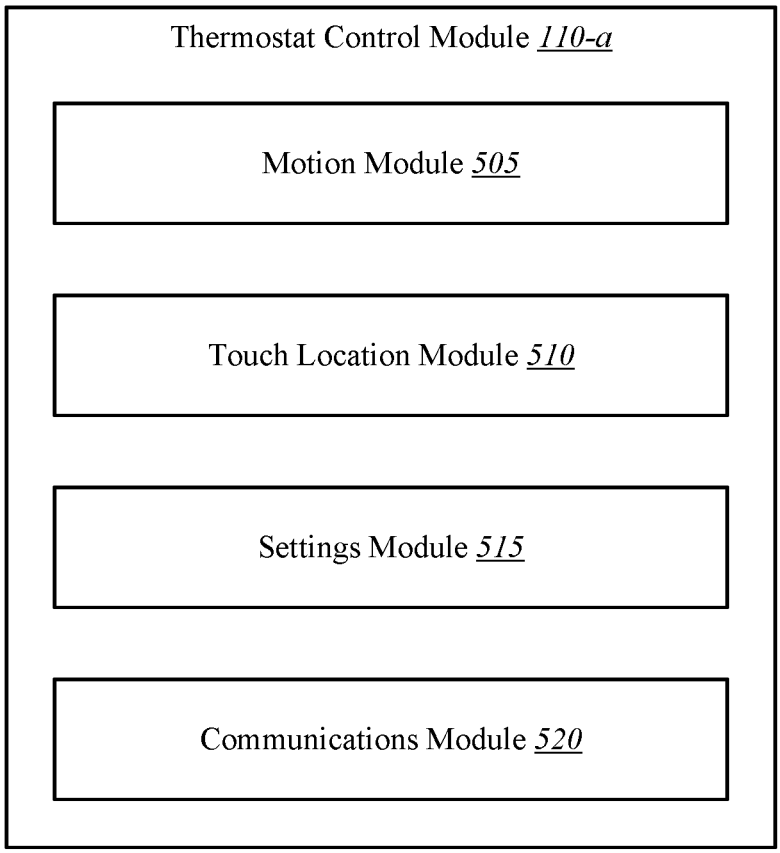
FIG. 5 is a block diagram of a thermostat control module for use with the environments of FIGS. 1-4.

FIG. 5 is a block diagram illustrating an example thermostat control module 110-*a*. Thermostat control module 110-*a* may be one example of the thermostat control module 110 described above with reference to FIGS. 1-4. Thermostat control module 110-*a* includes a motion module 505, a touch location module 510, a settings module 515, and a communications module 520. In other embodiments, thermostat control module 110-*a* may include more or fewer modules than those shown in FIG. 5.

Motion module 505 may operate to determine whether the housing 115 of thermostat 105 has moved. Motion module 505 may determine the type of movement (e.g., direction of motion and/or a portion of the housing 115 that moves). Motion module 505 may correlate the detected motion with a setting or adjustment associated with operation of the thermostat. For example, motion module 505 may detect a rotation motion of housing 115, and correlate the rotation motion to an increase in temperature setting. Motion module 505 may detect movement of a top right corner of housing 115 in a Y-axis direction, and correlate that movement with switching between a temperature adjustment setting and a time of day setting.

Touch location module 510 may operate to determine where on housing 115 a user applies a touch force. Touch location module 510 may determine the location of touch based at least in part on how housing 115 moves relative to a reference point. Touch location module 510 may determine location of a touch based at least in part on what part of housing 115 moves and/or how much movement occurs. In some examples, touch location module 510 determines the location of a touch based on a touch sensor input, such as touching in an active area of a touchscreen or touch sensor. Touch location module 510 may operate in conjunction with motion module 505 to determine what part of housing is touched and/or moved as part of providing input from a user to operate thermostat 105.

Settings module 515 may operate to adjust and/or set one or more settings, functions, or operations of the thermostat based on input from one or more of motion module 505 and touch location module 510. While motion module 505 and touch location module 510 may independently correlate between a type, location, or distance of motion for housing 115 in a particular setting of the thermostat, settings module 515 may carry out the adjustment to the particular setting.

Communications module 520 may operate to communicate with other devices, systems, and the like. For example, communications module 520 may facilitate sending and/or receiving instructions from HVAC system 305. Communications module 520 may facilitate receiving instructions or other communications from devices separate from thermostat 105. Communications module 520 may cooperate with, for example, transceiver 220 to facilitate the communications to and/or from thermostat 105. In other examples, communications module 520 may facilitate communications with the user who is operating thermostat 105. Communications module 520 may cooperate with, for example, display 210 and/or user interface 225 to provide such communications.

Figure 6:
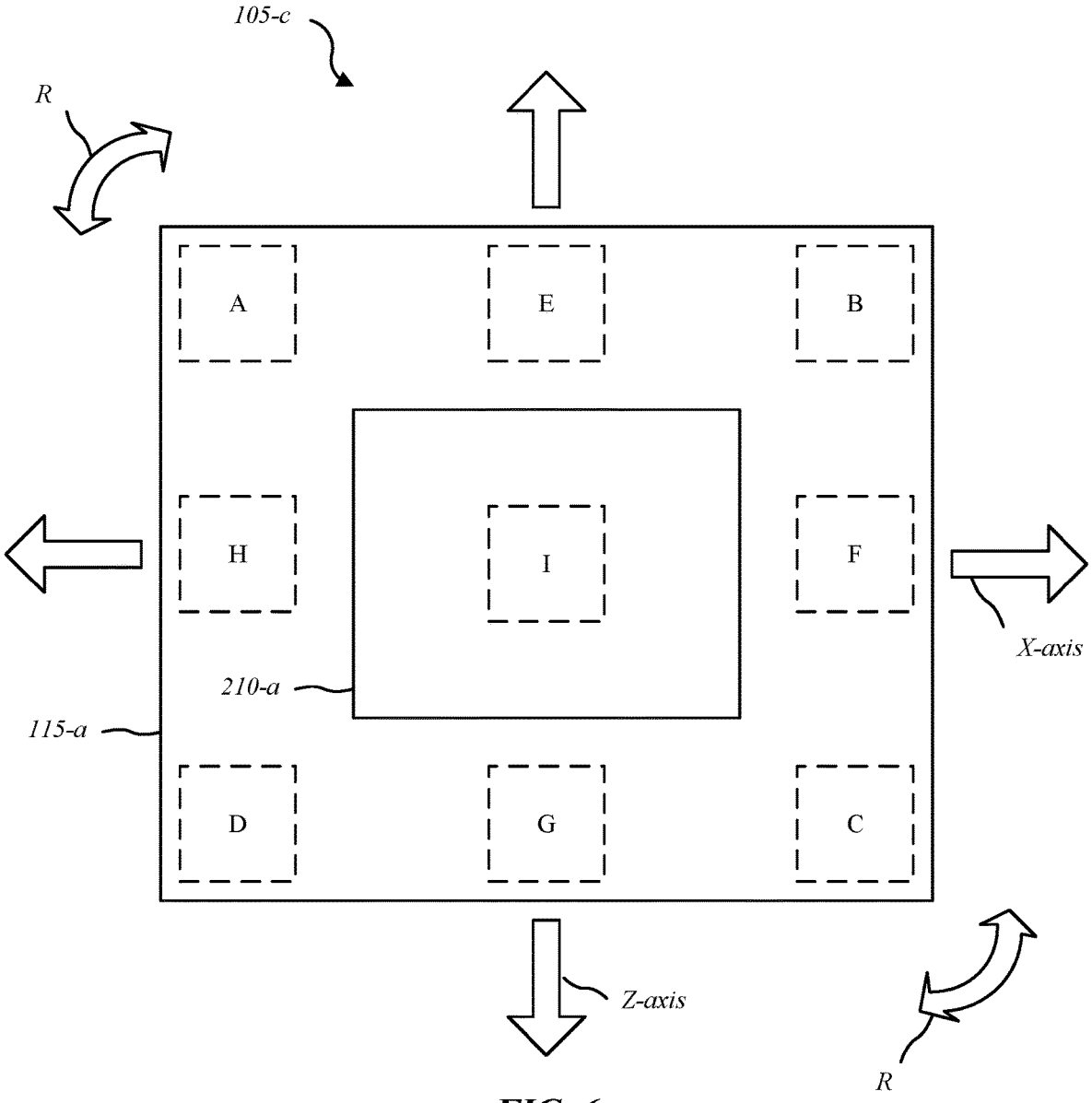
FIG. 6 is a schematic front view of a thermostat for use with the environments of FIGS. 1-4.

FIG. 6 is a schematic front view of an example thermostat 105-*c*. Thermostat 105-*c* may be one example of the thermostat 105 described above with reference to FIGS. 1-4. Thermostat 105-*c* may include a housing 115-*a* and a display 210-*a*. Thermostat 105-*c* may also include a plurality of input areas A-I located at spaced apart locations on housing 115-*a*.

Housing 115-*a* may have a plate-like structure. Housing 115-*a* has a rectangular shape with four corners. The input areas A-H are positioned around a periphery of a primary surface that faces a user when thermostat 105-*b* is mounted to a vertical surface of a wall structure. Input area I may be positioned centrally on housing 115-*a*. Nine different areas A-I are includes on housing 115-*a* with input areas A-D positioned at corners, and input areas E-H positioned at locations spaced between each of the corners and associated input areas A-D. Other arrangements are possible in which more or fewer input areas are included on the forward facing primary surface of housing 115-*a*. Furthermore, the input areas A-I may have different shapes and/or sizes than those shown in FIG. 6.

In other embodiments, thermostat 105-*c* may include additional input areas located at other locations on thermostat 105-*c*. For example, input areas may be located along side edges and/or surfaces, such as those surfaces of housing 115-*c* that face perpendicular to the wall surface to which thermostat 105-*c* is mounted. Input areas A-I may include a touch sensor or a touch-activated feature that is actuated independent of movement of housing 115-*a*. Additionally, or alternatively, a touch applied to any of input areas A-I may be determined based on a corresponding movement of housing 115-*a*, wherein the particular movement correlates with application of a force to one of input areas A-I. The movement of housing 115-*a* may be applied in one of the X-axis or Z-axis directions, or in the rotation direction R shown in FIG. 6. The user may apply a force along one of the edges and/or side surfaces of housing 115-*a* to impose motion in the X-axis or Z-axis directions or the rotation direction. In at least some examples, housing 115-*a* is sized sufficiently small so that a user can position fingers along multiple side edges thereof to apply a translational or rotational force to housing 115-*a*.

FIG. 6 shows housing 115-*a* having a sufficiently large size to cover components of thermostat 105-*c* that may be positioned physically behind housing 115-*a* (e.g., between housing 115-*a* and the wall surface). In at least some embodiments, only housing 115-*a* is visible when viewing thermostat 105-*c* from a front oriented position.

Display 210-*a* is shown mounted to or visible along a front facing primary surface of housing 115-*a*. In other examples, display 210-*a* is embedded in or positioned behind the front facing primary surface. In at least some examples, housing 115-*a* includes a transparent or translucent portion that permits viewing of at least portions of display 210-*a* through the material of housing 115-*a*.

Figure 7:
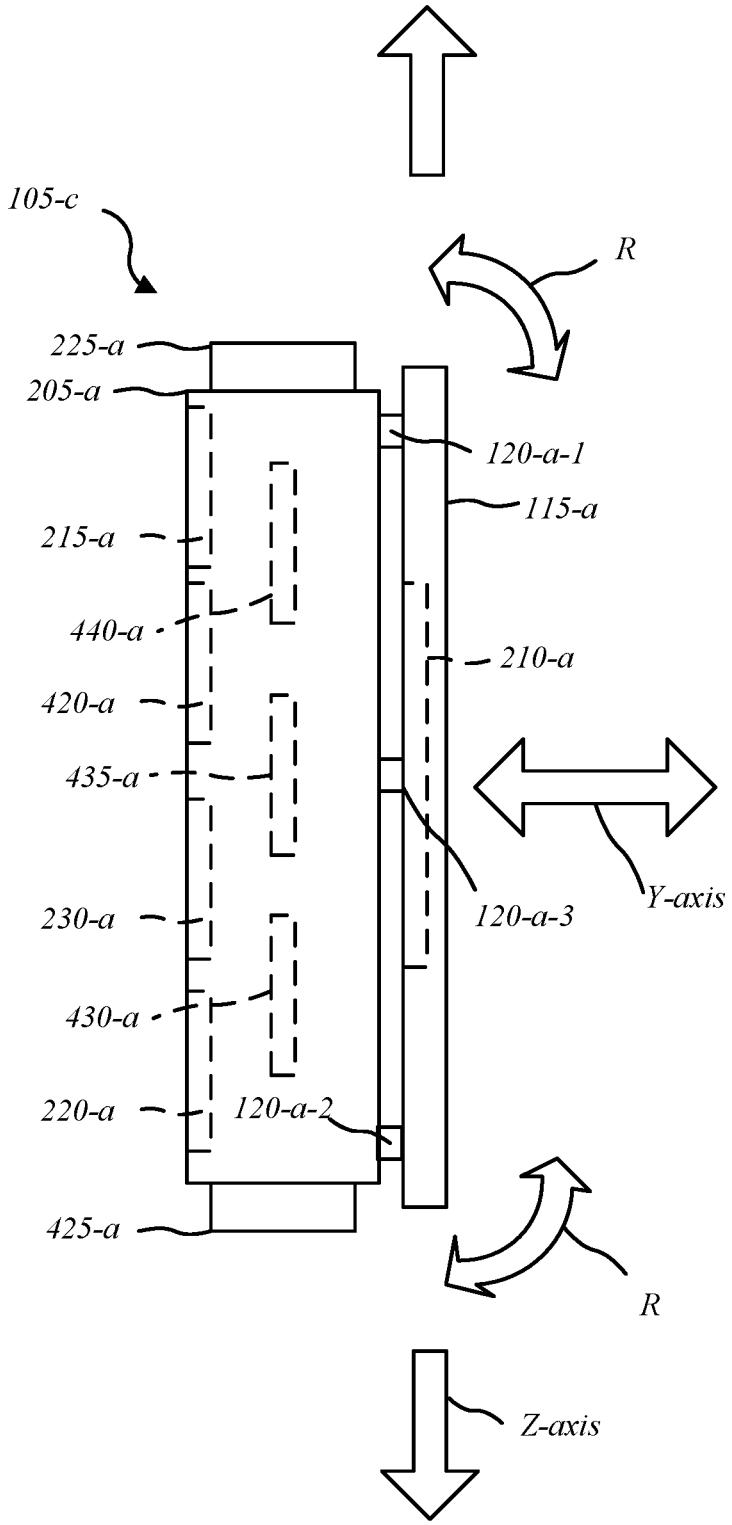
FIG. 7 is a schematic side view of the thermostat of FIG. 6.

FIG. 7 is a schematic side view of the thermostat 105-*c*. FIG. 7 shows display 210-*a* positioned behind a front facing primary surface of housing 115-*a* (e.g., embedded in housing 115-*a*). Housing 115-*a* may be supported by and/or mounted to a base 205-*a*. A plurality of sensors 120-*a* may be interposed between base 205-*a* and housing 115-*a*. In at least some examples, sensors 120-*a* may be mounted to or cooperate with a structural element that provides at least some support of and/or connection of housing 115-*a* to base 205-*a*. Such structural elements may include, for example, mechanical switches, sliding tracks, telescoping members, ratchet features, interference-fit connections, ball and socket, hinge, and/or biasing members. Sensors 120-*a* may determine at least in part relative movement between all or portions of housing 115-*a* and base 205-*a* and/or a wall support to which thermostat 105-*c* is mounted.

Thermostat 105-*c* may include a plurality of components that are mounted to and/or retained within base 205-*a*. For example, thermostat 105-*c* may include a controller 215-*a*, a transceiver 220-*a*, a user interface 225-*a*, and memory 230-*a*. Thermostat 105-*c* may also include a light source 420-*a*, a proximity sensor 425-*a*, a feedback device 430-*a*, a positioning device 435-*a*, and a locking member 440-*a*. Light source 420 may operate to illuminate housing 115-*a* or a space surrounding thermostat 105-*c*. Proximity sensor 425-*a* may operate to determine proximity of one or more objects to thermostat 105-*c*. In one example, proximity sensor 425-*a* actuates light source 420-*a* when a user is in close proximity to thermostat 105-*c*, and turns off light source 420 when the user is determined to have moved away from thermostat 105-*a*. In some embodiments, light source 420-*a* may automatically turn on/off based on a touch force applied to housing 115-*a* and/or operation of other features of thermostat 105-*c*. In some embodiments, detecting proximity of a user may be used to operate thermostat 105-*c* from a sleep mode to an active mode. No detection of a user for a predetermined amount of time may be used to operate thermostat 105-*c* from an active mode to a sleep mode. Feedback device 430-*a*, positioning device 435-*a*, and locking member 440-*a* may provide at least the same features and functionality described above with reference to the description of feedback device 430, positioning device 435 and locking member 440 shown in FIG. 4.

FIG. 7 shows base 205-*a* and other components of thermostat 105-*b* exposed for viewing and/or contact outside of housing 115-*a*. Other embodiments are possible in which housing 115-*a* extends over, conceals, and/or encloses all or a majority of the other components of thermostat 105-*b* including base 205-*a*.

FIG. 7 also illustrates possible movement of housing 115-*a* in the Y-axis and Z-axis directions, and pivot or rotation directions R. Different portions of housing 115-*a* may move towards or away from base 205-*a* more or less than other portions of housing 115-*a*. These variations in movement of different portions of housing 115-*a* may correspond with where housing 115-*a* is touched (e.g., where a touch force is applied by a user), and an associated operation and/or adjustment for thermostat 105-*c*. The movement of housing 115-*a* relative to base 205 may be referred to as free-floating or movable in at least one direction of motion. In at least some embodiments, the entire housing is free-floating in at least one direction of motion. Thermostat 105-*c* may be limited in its operation to control of HVAC settings and setup of the thermostat, or at least movement of housing 115-*a* may correspond only to HVAC settings for a property and/or setup of the thermostat.

Figure 8:
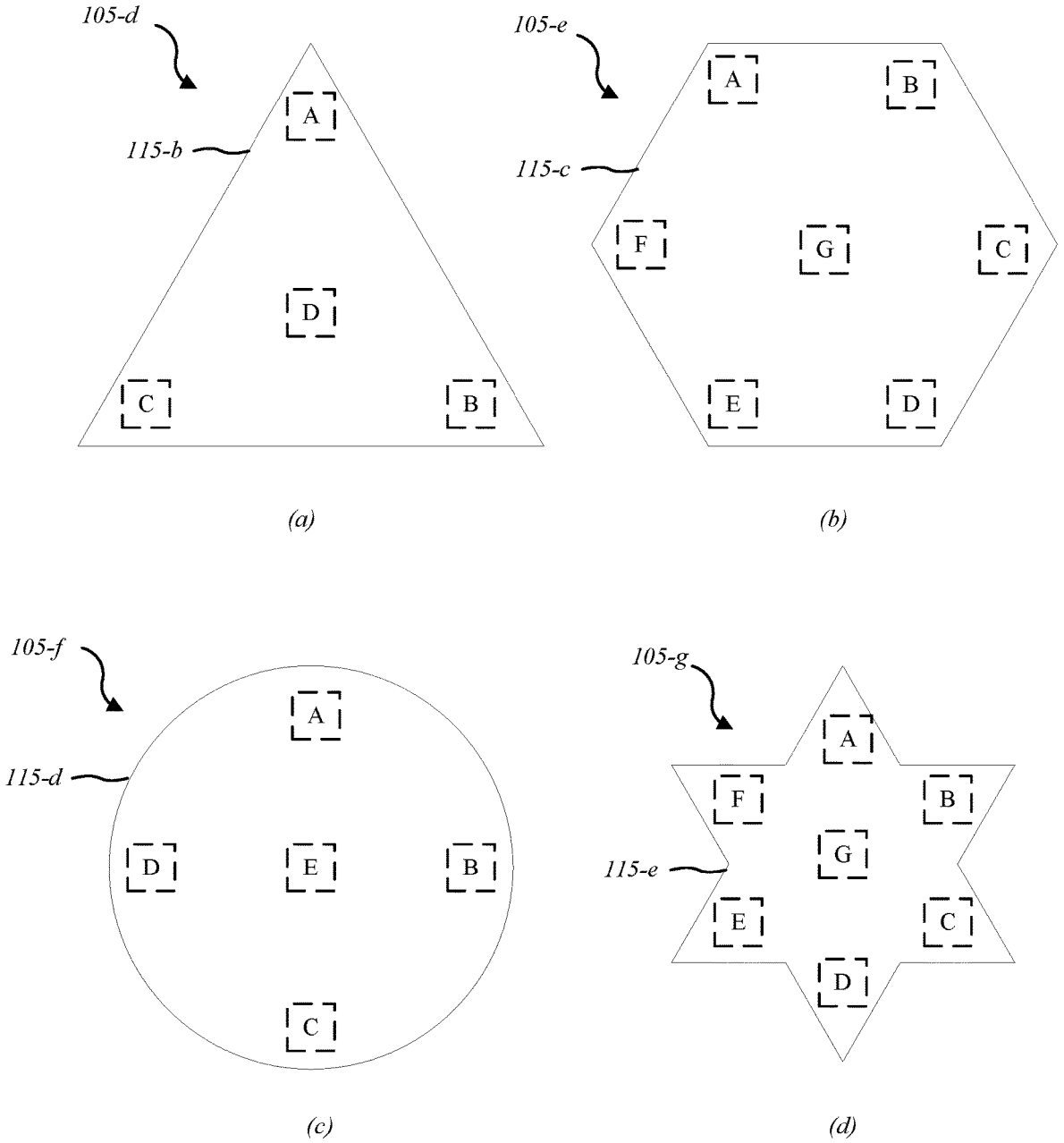
FIGS. 8*a*-8*d* are schematic front views of alternative thermostats for use with at least the environment of FIG. 4.

FIG. 8 is a schematic front view of a plurality of different thermostats 105. Thermostat 105-*d* includes a housing 115-*b* having a plurality of input areas A-D. Housing 115-*b* has a triangular shape. Thermostat 105-*e* includes a housing 115-*c* with a plurality of input areas A-G. Housing 115-*c* has a hexagonal shape. Thermostat 105-*f* has a housing 115-*d* with a plurality of input areas A-E. Housing 115-*d* has a circular shape. Thermostat 105-*g* has a housing 115-*e* with a plurality of input areas A-G. Housing 115-*e* has a star shape.

The shapes of the housings and the input areas shown in FIGS. 8*a*-8*d* are merely exemplary of the many different housing shapes and input area configurations possible. The housings shown in FIGS. 8*a*-8*d* may have plate constructions with a significantly greater length and/or width on the front facing primary surface as compared to a thickness of the housing. Some housing embodiments have a cavity formed therein to enclose at least portions of a base and/or other components of the thermostat.

Figure 9:
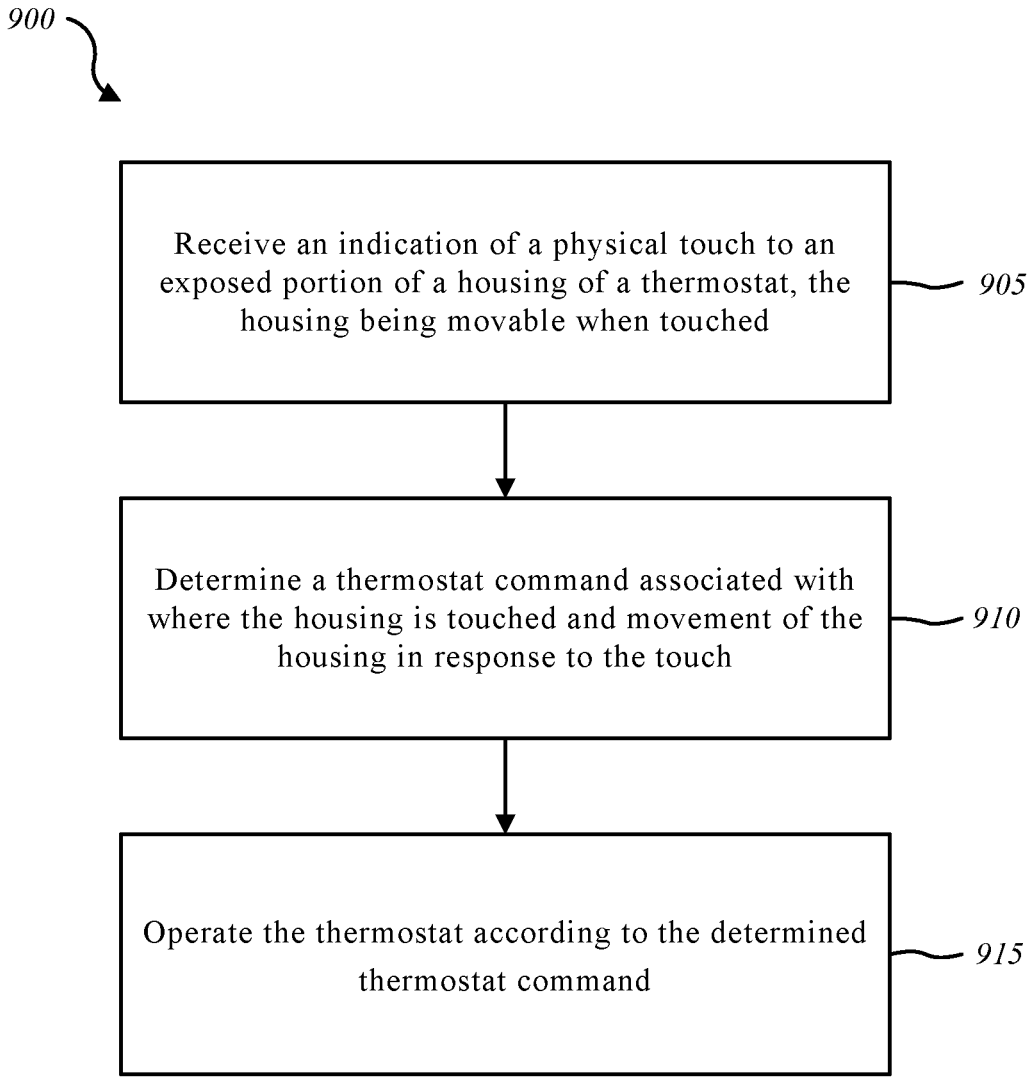
FIG. 9 is a flow diagram illustrating a method for operating a wall mounted thermostat in accordance with the present systems and methods.

FIG. 9 is a flow diagram illustrating one embodiment of a method 900 for operating a wall mounted thermostat. In some configurations, the method 900 may be implemented by the thermostat control module 110 shown and described with reference to FIGS. 1-5. In other examples, the method 900 may be performed generally by thermostat 105 shown in FIGS. 1-4 and 6-7, or even more generally by environments 100, 200, 300, 400 shown in FIGS. 1-4.

At block 905, the method 900 includes receiving an indication of a physical touch to an exposed portion of a housing of the thermostat, wherein the housing is moveable when touched. At block 910, the method 900 includes determining a thermostat command associated with where the housing is touched and movement of the housing in response to the touch. Block 915 includes operating the thermostat according to the determined thermostat command.

The entire housing may be movable according to method 900. The thermostat command may include at least one of a temperature adjustment, a heat on/off actuation, a cool on/off actuation, a fan adjustment, a set-up mode operation, a query of a state or status of one or more system functions, an acknowledgement or clearing of a status indicator, or an input or feedback related to at least one of an HVAC zone selection, a damper control, an air exchanger control, a humidifier control, a dehumidifier control, and an air leaning system control. Operating the thermostat may include transmitting instructions to/from at least one of HVAC system, a control panel, remote computing device, and a central station. Method 900 may include displaying information on a display screen mounted to or visible through the housing. Method 900 may include detecting presence of a user in proximity to the thermostat, and executing a programmed response to the detected presence, such as operating a light of the thermostat.

Figure 10:
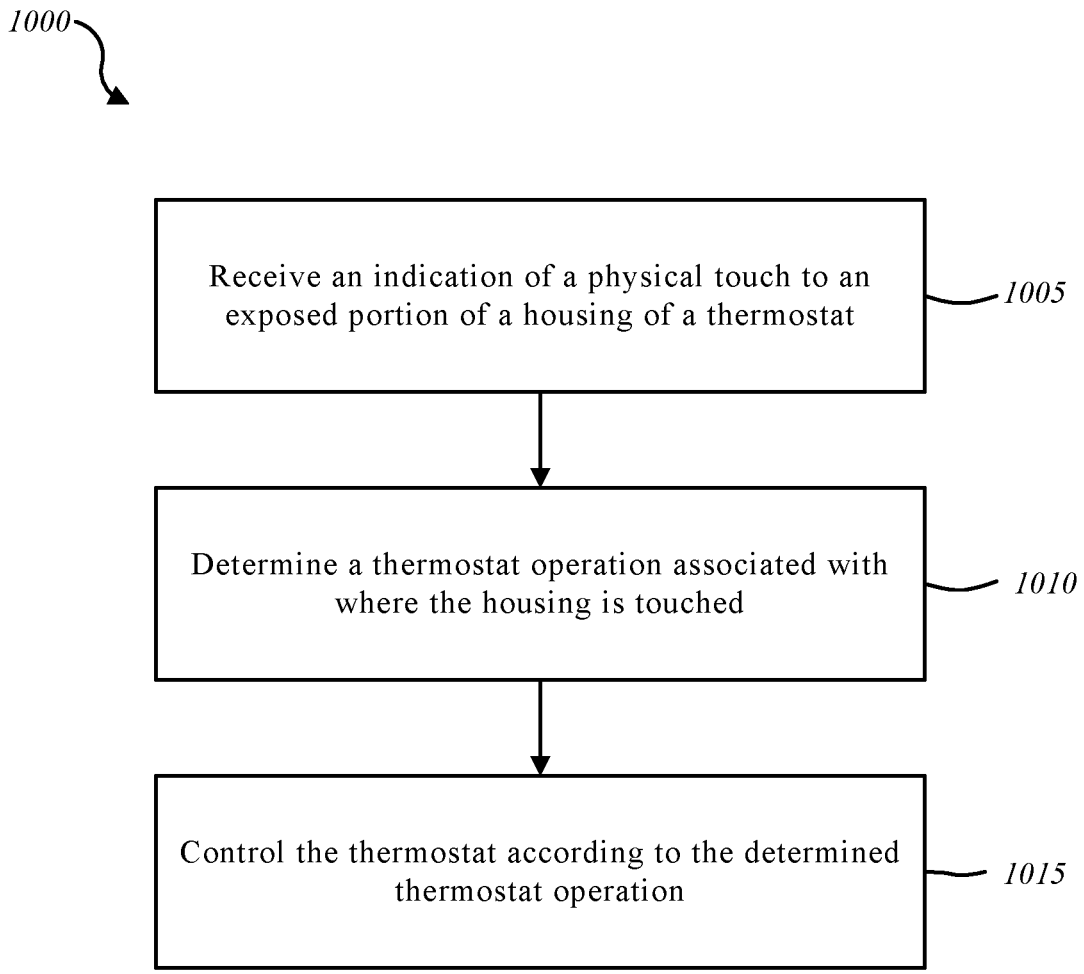
FIG. 10 is a flow diagram illustrating a method for controlling a thermostat in accordance with the present systems and methods.

FIG. 10 is a flow diagram illustrating one embodiment of a method 1000 for mapping a living space. In some configurations, the method 1000 may be implemented by the thermostat control module 110 shown and described with reference to FIGS. 1-8. In other examples, the method 1000 may be performed generally by thermostat 105 shown in FIGS. 1-4 and 6-8, or even more generally by environments 100, 200, 300, 400 shown in FIGS. 1-4.

At block 1005, the method 1000 includes receiving an indication of a physical touch to an exposed portion of a housing of the thermostat. Block 1010 includes determining the thermostat operation associated with where the housing is touched. Block 1015 includes controlling the thermostat according to the determined thermostat operation.

Figure 11:
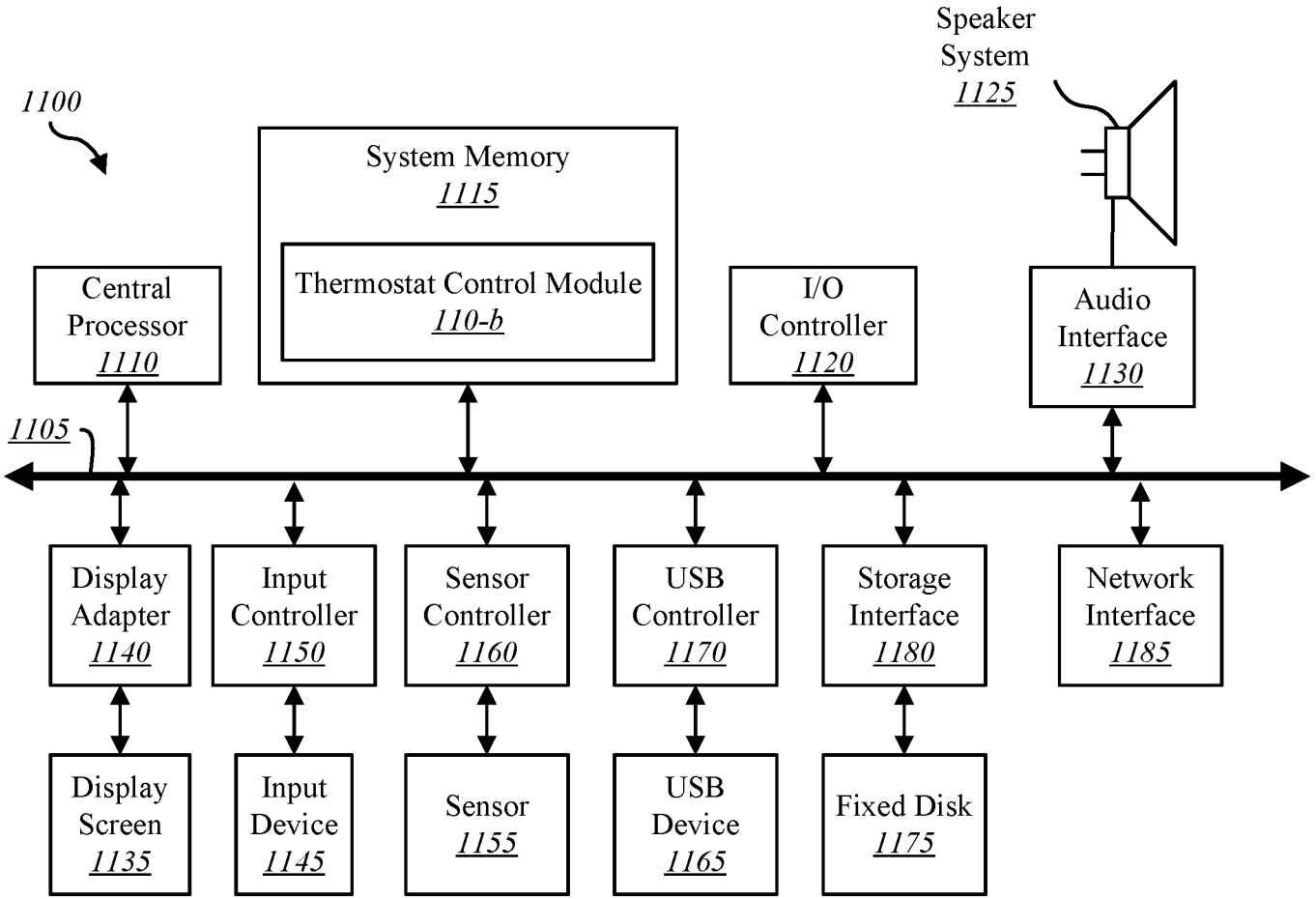
FIG. 11 is a block diagram of a computer system suitable for implementing the present systems and methods of FIGS. 1-10.

FIG. 11 depicts a block diagram of a controller 1100 suitable for implementing the present systems and methods. Controller 1100 may include, for example, the thermostat 105 described with reference to FIGS. 1-4, 7 and 8. In one configuration, controller 1100 includes a bus 1105 which interconnects major subsystems of controller 1100, such as a central processor 1110, a system memory 1115 (typically RAM, but which may also include ROM, flash RAM, or the like), an input/output controller 1120, an external audio device, such as a speaker system 1125 via an audio output interface 1130, an external device, such as a display screen 1135 via display adapter 1140, an input device 1145 (e.g., remote control device interfaced with an input controller 1150), multiple USB devices 1165 (interfaced with a USB controller 1170), and a storage interface 1180. Also included are at least one sensor 1155 connected to bus 1105 through a sensor controller 1160 and a network interface 1185 (coupled directly to bus 1105).

Bus 1105 allows data communication between central processor 1110 and system memory 1115, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the thermostat control module 110-*b* to implement the present systems and methods may be stored within the system memory 1115. Applications resident with controller 1100 are generally stored on and accessed via a non-transitory computer readable medium, such as a hard disk drive (e.g., fixed disk drive 1175) or other storage medium. Additionally, applications can be in the form of electronic signals modulated in accordance with the application and data communication technology when accessed via network interface 1185.

Storage interface 1180, as with the other storage interfaces of controller 1100, can connect to a standard computer readable medium for storage and/or retrieval of information, such as a fixed disk drive 1175. Fixed disk drive 1175 may be a part of controller 1100 or may be separate and accessed through other interface systems. Network interface 1185 may provide a direct connection to a remote server via a direct network link to the Internet via a POP (point of presence). Network interface 1185 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 1100 wirelessly via network interface 1185.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 11 need not be present to practice the present systems and methods. The devices and subsystems can be interconnected in different ways from that shown in FIG. 11. The aspect of some operations of a system such as that shown in FIG. 11 are readily known in the art and are not discussed in detail in this application. Code to implement the present disclosure can be stored in a non-transitory computer-readable medium such as one or more of system memory 1115 or fixed disk drive 1175. The operating system provided on controller 1100 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A computer implemented method for operating a wall mounted thermostat, comprising:

detecting a movement of an exposed portion of a housing of the thermostat;

determining a type of the detected movement of the exposed portion of the housing;

determining a resistance force based at least in part on one of a group consisting of a type of force of the detected movement, a type of adjustment associated with a type of movement of the detected movement, a detected user, or combinations thereof;

providing the resistance force to the housing as feedback in response to the detected movement of the exposed portion of the housing;

correlating the type of the detected movement of the exposed portion of the housing with a thermostat command associated with operation of the thermostat; and operating the thermostat according to the thermostat command.

2. The method of claim 1, further comprising:

receiving an indication of a physical touch to the exposed portion of the housing of the thermostat, wherein the thermostat command is further based at least in part on the indication of the physical touch.

3. The method of claim 1, wherein the thermostat command includes at least one of a temperature adjustment, a heat on/off actuation, a cool on/off actuation, a fan adjustment, a setup mode operation, a query of a state or status of one or more system functions, an acknowledgement or clearing of a status indicator, or an input or feedback related to at least one of an HVAC zone selection, a damper control, an air exchanger control, a humidifier control, a dehumidifier control, and an air leaning system control.

4. The method of claim 1, wherein operating the thermostat includes transmitting instructions to an HVAC device.

5. The method of claim 1, further comprising:

displaying information on a display screen mounted to or visible through the housing.

6. A wall mounted thermostat, comprising:

a base coupled in a fixed position relative to a wall surface, the base including a controller of the wall mounted thermostat;

a housing coupled with the base, the housing configured to move relative to the base; and a plurality of sensors operable to detect a movement of the housing of the thermostat;

wherein the movement of the housing in any of a plurality of directions relative to the wall surface to which the thermostat is mounted as detected by the at least one of the plurality of sensors initiates a thermostat command.

7. The thermostat of claim 6, wherein the plurality of sensors is further operable to receive an indication of a physical touch to an exposed portion of the housing of the thermostat, wherein the thermostat command is further based at least in part on the indication of the physical touch.

8. The thermostat of claim 6, further comprising:

a feedback device to provide a resistance force on the housing based at least in part on one of the group consisting of a type of force of the detected movement, a type of adjustment associated with a type of movement of the detected movement, a detected user, or combinations thereof.

9. The thermostat of claim 6, wherein the housing is movable at least rotationally, toward or away, laterally, or vertically relative to a support surface to which the thermostat is mounted.

10. The thermostat of claim 6, wherein the housing includes a display screen.

11. The thermostat of claim 6, wherein the housing pivots about at least one ball and socket joint relative to a support surface to which the thermostat is mounted.

12. The thermostat of claim 6, further comprising:

a plurality of input areas positioned around a periphery of a surface of the housing, wherein the detected movement is further based on application of a force to at least one of the input areas.

13. The thermostat of claim 12, wherein the plurality of input areas are located along a side edge of an exposed portion of the housing.

14. The thermostat of claim 6, further comprising:

a processor;

a memory; and a power supply;

wherein the processor is operable to determine using input from the at least one sensor what thermostat command corresponds to the housing movement.

15. A computing device configured for controlling a thermostat, comprising:

a processor;

a memory in electronic communication with the processor, wherein the memory stores computer executable instructions that when executed by the processor cause the processor to perform the steps of:

detect a movement of an exposed portion of a housing of the thermostat;

determine a type of the detected movement of the exposed portion of the housing;

determine a resistance force based at least in part on one of a group consisting of a type of force of the detected movement, a type of adjustment associated with a type of movement of the detected movement, a detected user, or combinations thereof;

provide the resistance force to the housing as feedback in response to the detected movement of the exposed portion of the housing;

correlate the type of the detected movement of the exposed portion of the housing with a thermostat command associated with operation of the thermostat; and operate the thermostat according to the thermostat command.

* * * * *